US005421420A

United States Patent [19]

Malone et al.

[11] Patent Number: 5,421,420

[45] Date of Patent: Jun. 6, 1995

[54] DOWNHOLE WEIGHT-ON-BIT CONTROL FOR DIRECTIONAL DRILLING

[75] Inventors: David L. Malone; Jacques J. Orban, both of Sugar Land, Tex.

[73] Assignee: Schlumberger Technology Corporation, Sugar Land, Tex.

[21] Appl. No.: 255,135

[22] Filed: Jun. 7, 1994

[51] Int. Cl.[6] ..... E21B 7/06

[52] U.S. Cl. ..... 175/61; 175/73; 175/321

[58] Field of Search ..... 175/45, 61, 73, 74, 175/79, 80, 321

[56] References Cited

U.S. PATENT DOCUMENTS

| | | | |
|---|---|---|---|
| 3,637,032 | 1/1972 | Jeter . | |
| 3,961,674 | 6/1976 | Craig, Jr. et al. | 175/45 |
| 3,997,008 | 12/1976 | Kellner | 175/45 |
| 4,040,494 | 8/1977 | Kellner . | |
| 4,076,084 | 2/1978 | Tighe | 175/61 X |
| 4,144,941 | 3/1979 | Ritter | 175/61 X |
| 4,220,213 | 9/1980 | Hamilton | 175/61 X |
| 4,291,773 | 9/1981 | Evans . | |
| 4,305,462 | 12/1981 | Eilers et al. | 175/61 X |
| 4,461,359 | 7/1984 | Jones, Jr. et al. . | |
| 4,518,048 | 5/1985 | Varley | 175/61 |
| 4,637,479 | 1/1987 | Leising . | |
| 4,714,118 | 12/1987 | Baker et al. . | |
| 4,821,815 | 4/1989 | Baker et al. . | |
| 4,836,301 | 6/1989 | Van Dongen et al. . | |
| 4,858,705 | 8/1989 | Thiery | 175/45 X |
| 4,867,265 | 9/1989 | Baker et al. . | |
| 4,928,776 | 5/1990 | Falgout, Sr. | 175/45 |
| 4,995,465 | 2/1991 | Beck et al. . | |
| 5,009,272 | 4/1991 | Walter . | |
| 5,265,682 | 11/1993 | Russell et al. . | |
| 5,311,954 | 5/1994 | Quintana | 175/321 X |

FOREIGN PATENT DOCUMENTS

| | | |
|---|---|---|
| 2246151A | 1/1992 | United Kingdom . |
| WO90/05235 | 5/1990 | WIPO . |

*Primary Examiner*—Ramon S. Britts
*Assistant Examiner*—Frank S. Tsay
*Attorney, Agent, or Firm*—David L. Moseley; Wayne I. Kanak

[57] ABSTRACT

Directional drilling is achieved by a weight-on-bit control mechanism that is attached to a drill bit having asymmetrical cutters. A valve in the mechanism temporarily interrupts or bypasses mud flow toward the bit to correspondingly change the downward force acting thereon during a portion of each revolution. The bit will drill preferentially on that side of the bottom surface of the borehole where the downward force is increased, and thereby cause the borehole to curve in an azimuthal direction on such side.

23 Claims, 2 Drawing Sheets

DOWNHOLE WEIGHT-ON-BIT CONTROL FOR DIRECTIONAL DRILLING

BACKGROUND OF THE INVENTION

1. Field of the Invention

This invention relates generally to new and improved methods and apparatus for directionally drilling a borehole into the earth, and particularly to a directional drilling system where the weight being applied to a rotary drill bit having asymmetric cutters is increased in a synchronous manner during each revolution to cause the bit to drill preferentially in a certain azimuthal direction.

2. Description of the Related Art

Various techniques have been used to drill boreholes directionally toward a designated underground target earth formation. As used herein unless the context indicates otherwise, the word "directional" means the inclination of a borehole with respect to vertical, and the azimuth of such inclination with respect to magnetic North. A well bore drilled from an offshore platform, for example, might have an initial section that extends substantially vertical to a given depth, and there the borehole is curved at a certain azimuth by gradually building up the inclination. Then the borehole may be drilled straight ahead in that direction until the hole bottom approaches a particular target, at which point the borehole may be curved gradually back downward to the vertical while holding the same azimuth. Finally the borehole is drilled straight ahead, i.e. vertically downward, through the target earth formation. In this manner a large number of wells which penetrate the formation at numerous spaced points can be drilled from a single platform in order to drain the formation of oil and/or gas in an efficient and economic manner.

Various devices have been employed to achieve directional drilling as set forth above. One system provides a drill string having stabilizers positioned thereon at certain distances so as to achieve directional drilling using the pendulum effect of the lower section of the drill string. This system has the disadvantage that the drilling string must be withdrawn from the well several times during the drilling to change the number and location of stabilizers. Of course each round trip is time-consuming and expensive. Another system uses a downhole motor to drive the drill bit, together with a bent sub located in the drill string above the motor. The bent sub provides an angular offset that can be used to orient the bit in the desired azimuth, particularly where a directional measurement system in included in the drill string. While adequate to drill a curved borehole, this system is not capable of drilling a straight or tangent hole section. Thus the drill string must be tripped out to remove the bent sub when a straight hole section is to be drilled.

Still another directional drilling system uses a "steerable" drilling motor where the bend angle is provided in a housing between the motor power section and the bit. The bent housing causes the bit to drill along a curved path and substantially reduces the stresses in the threaded connections which support the bend. When straight ahead drilling is needed, the drill string is rotated at the surface so that such rotation is superimposed over that of the motor drive shaft. This causes the bend point to merely orbit about the axis of the borehole so that the bit drills straight ahead rather than along a curve. To resume directional drilling the superimposed rotation is stopped. Although this type of directional drilling is effective and has been widely used, the drilling motor is a specialized and expensive item of equipment that tends to wear out somewhat rapidly.

An object of the present invention is to provide a new and improved directional drilling method and system which avoids the difficulties and problems experienced with the foregoing prior systems.

Another object of the present invention is to provide a new and improved directional drilling tool where additional weight is periodically and synchronously applied to an asymmetric rotary drill bit to cause the bit to drill along a curved path.

Another object of the present invention is to provide a new and improved directional drilling system where a rotary drill bit having asymmetrically arranged cutters is subjected to increased weight during a selected portion of each revolution so that the bit drills preferentially on one side of the bottom of the borehole and causes the hole to be drilled along a curve in a selected azimuthal direction.

Still another object of the present invention is to provide a method for controlling the weight-on-bit downhole with minimal intervention from the surface.

SUMMARY OF THE INVENTION

These and other objects are attained in accordance with the concepts of the present invention through the provision of a drill string having a weight-on-bit (WOB) control mechanism and an asymmetric or asynchronous drill bit on the lower end thereof. The control mechanism includes a control valve which is selectively operated to temporarily increase the mud pressure, which acts downward on a piston on which the bit is mounted, during a portion of each revolution of the bit. Such increased pressure temporarily increases the weight-on-bit in a manner that is synchronized to the rotation of the drill string. The bit may have for example, two radial rows of polycrystalline diamond compact (PDC) cutters and one radial row of tungsten support balls located 120° apart. The "hammering" action on the bit and cutters due to periodic increases in WOB as the cutters sweep one side of the hole bottom causes the borehole to be drilled along a curved path on that side of the hole.

The actuation of the control valve is responsive to the output signal of a controller in a measuring-while-drilling (MWD) tool which is incorporated in the drill string above the control valve. Such MWD tool typically includes a navigation system by which the direction of the borehole is measured and transmitted to the surface. Orientation sensors included in such navigation system are used to actuate the control valve synchronously with the rotation of the drill string so that the desired periodic increases in WOB are achieved. In one embodiment the control valve temporarily restricts flow of drilling fluids toward the bit to increase the pressure acting downward on the piston. In another embodiment a control valve temporarily bypasses drilling fluids to the annulus to reduce the pressure on a piston, and then closes to increase the pressure on such piston. In either case the weight-on-bit is cyclically increased to cause the bit to drill directionally as noted above.

BRIEF DESCRIPTION OF THE DRAWINGS

The present invention has the above as well as additional objects, features and advantages which will become more clearly apparent in connection with the following detailed description of preferred embodiments, taken in conjunction with the appended drawings in which.

DESCRIPTION OF THE PREFERRED EMBODIMENTS

Figure 1:
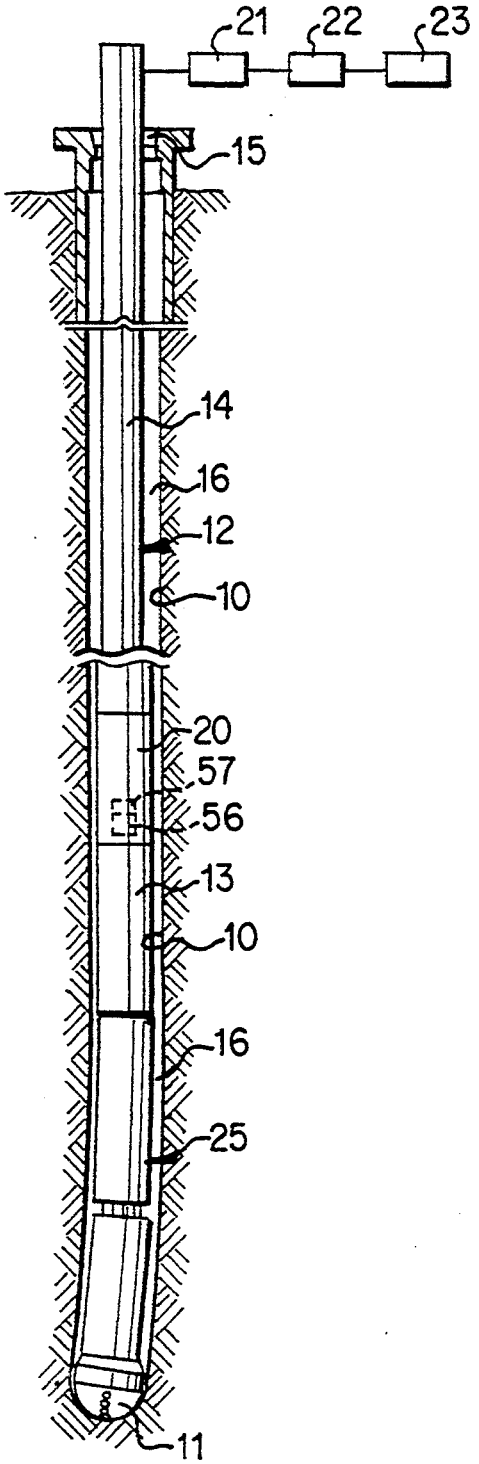
FIG. 1 is a schematic view of a borehole being directionally drilled using the present invention.

Referring initially to FIG. 1, a borehole 10 is shown being drilled in the earth by a rotary drill bit 11 that is attached to the lower end of a drill string 12. The drill string 12, which typically includes a length of drill collars 13 and a length of drill pipe 14, is turned at the surface by the rotary 15 of a drilling rig (not shown). Drilling fluids or mud are pumped down through the drill string 12 and exit through jets in the bit 11 where they are circulated back up to the surface through the annulus 16. The drill string 12 is suspended on a hook, cables, and the crown block of the rig, and a selected portion of the weight of the drill collars 13 is imposed on the bit 11 to cause it to drill through the rock.

An MWD tool 20 is connected in the string of drill collars 13 several joints above the bit 11. The MWD tool 20, as disclosed in U.S. Pat. Nos. 4,100,528; 4,103,281; 4,167,000; and 5,237,540 which are incorporated herein by reference, includes a siren-type signaling valve that imparts encoded pressure pulses to the mud stream passing therethrough, such pulses being representative of measurements made by various instruments located in or on the MWD tool 20. These instruments may include directional sensors such as inclinometers and magnetometers, and devices used to measure formation characteristics such as rock resistivity, gamma radiation and the like. Other variables such as weight and torque on the bit also can be measured and telemetered uphole. The mud flows through a turbine in the MWD tool 20 which drives a generator that supplies electrical power to the system. Signals representative of such measurements are processed and fed to a motor controller coupled to the signaling valve. The pressure pulses in the mud stream are detected at the surface at detector 21, decoded at decoder 22, and displayed and/or recorded at recorder 23. Each of the measurements, including the direction of the borehole 10 is available at the surface substantially in real time.

The inclination angle of the borehole typically is measured by a package of three inclinometers mounted on orthogonal axes, whereas the azimuth of that inclination angle is measured by a package of three magnetometers mounted on orthogonal axes. The output signals from all six instruments can be combined to define the "direction" of a borehole.

Figure 2:
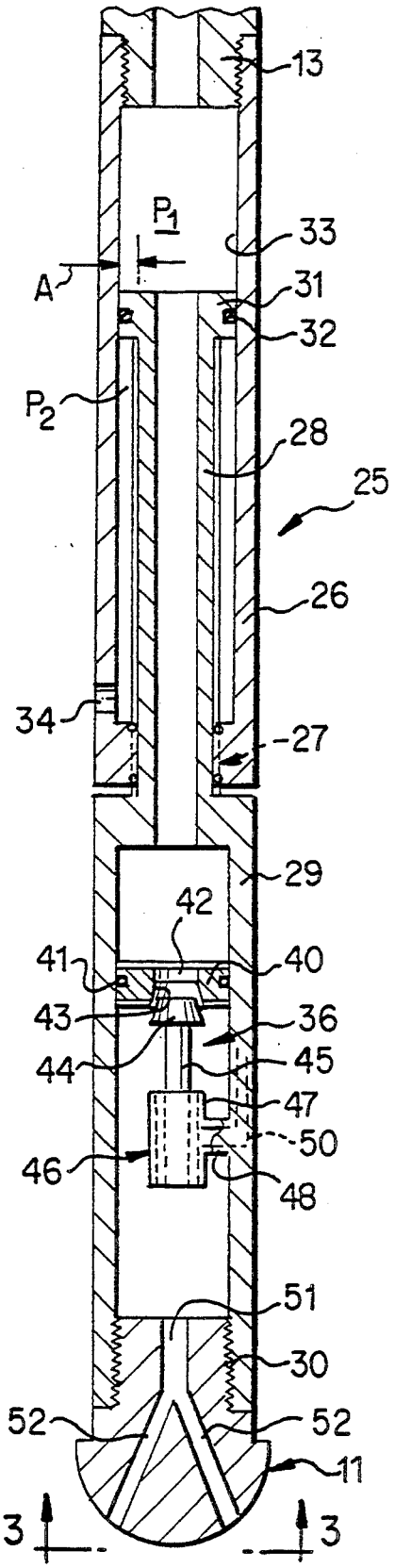
FIG. 2 is a longitudinal cross-sectional view of the directional drilling tool of FIG. 1.

A weight-on-bit control mechanism 25 is located in the collar string between the MWD tool 20 and the drill bit 11. As shown in FIG. 2, the WOB control mechanism 25 includes an elongated tubular housing 26 having a slidable spline connection 27 at its lower end to a mandrel 28 on the upper end of a tubular housing 29 which is connected to the drill bit 11 at threads 30. The upper end of the mandrel 28 carries an outwardly directed piston 31 having seals 32 that slidably engage the inner wall 33 of the housing 26. One or more ports 34 which extend through the wall of the housing 26 below the piston 31 communicate the annular space below the piston with the well annulus 16. The pressure above the piston 31 is designated $P_1$, and the pressure in the annular space below it is designated $P_2$. In addition to preventing relative rotation between the housings 26 and 29, the splines 27 allow downward force on the mandrel 28 to be transmitted to the bit 11.

A control valve assembly 36 is mounted in the lower tubular housing 29. The valve assembly 36 includes a disc or body 40 that is fixed within the housing 29 and which has a seal ring 41 to prevent fluid leakage. A central flow passage 42 and a conical seat 43 are formed in the body 40, and a valve element 44 on the upper end of a stem 45 is arranged for movement between a lower position where the passage 42 is open, and an upper position against the seat 43 where the passage 42 is closed or at least highly restricted. The position of the valve element 44 is controlled by solenoid actuator 46 having a coil mounted within a cylinder 47 that is attached to the wall of the lower housing 29 by an arm 48. The stem 45 is attached to a core that is slidable in the cylinder 47, so that the core, stem 45 and valve element 44 shift upward when the coil is energized via conductor wires 50 that extend upward along the housings 29 and 26 to the MWD tool 20. In the absence of current the valve element 44 shifts downward to the open position as shown.

Figure 3:
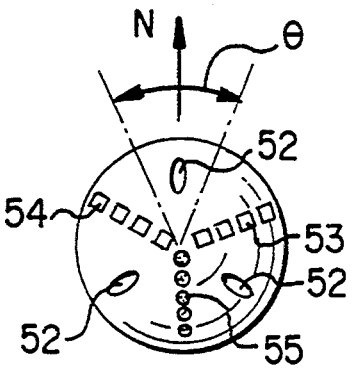
FIG. 3 is a bottom view on line 3—3 of FIG. 2 showing the asymmetric arrangement of cutters on the bottom of the drill bit.

The drill bit 11 has a central flow passage 51 which divides into jet ports 52 that open through the rounded lower surface of the bit. As shown in FIG. 3, the bit cutters are asymmetrical, having two radial rows 53, 54 of active polycrystalline diamond compact (PDC) cutters spaced 120° apart, and a third row 55 of tungsten carbide ball-shaped inserts which do not perform a cutting function. With this arrangement of cutting blades, it will be recognized that when the WOB is temporarily increased each time the active cutters 53, 54 pass over a certain side or sector of the bottom face of the borehole 10, the bit 11 will drill more effectively on that side and the borehole 10 will gradually build inclination angle or curve in that azimuthal direction.

A temporary increase in WOB during a portion of each revolution of the drill bit 11 is effected by synchronous operation of the control valve assembly 36 to momentarily close the flow passage 42 in the valve body 40. With the valve element 44 open, there is a downward pressure force on the mandrel 28 equal to the pressure drop across the bit 11 times the cross sectional area A of the piston 31. When the valve element 44 is seated in the valve seat 43, the fluid pressure $P_1$ above the piston 31 suddenly builds up even higher relative to $P_2$ so that an increased downward pressure force is applied to the piston 31. This pressure force adds to the weight already being applied to the bit 11, and is equal to $P_1$–$P_2$ times the transverse cross-sectional area A of the piston 31. The increased total downward force on the bit 11 is applied momentarily until the control valve assembly 36 is opened to allow drilling fluids to again flow through the passage 42.

Current to energize solenoid actuator 46 is supplied by the power source within the MWD tool 20 through a synchronizing switch 56 which can be controlled by the output signals from the directional package 57 in the MWD tool 20. It will be recognized that valve element 44 may be actuated by alternative means to solenoid actuator 46, such as, for example, a hydraulic cylinder. During each revolution of the drill string 12, the magnetometers in the directional package 57 provide output signals representing various compass angles, and such signals are used to operate the switch 56 and thus the control valve assembly 36 synchronously with the rotation of the drill string 12 and the bit 11.

OPERATION

In operation, the drill string 12 including the asymmetrical drill bit 11, the WOB control mechanism 25 and the MWD tool 20 are run into the borehole 10 until the bit 11 is on bottom. Mud circulation then is established by operating the pumps (not shown) at the surface, and a desired WOB is established by slacking off that amount of the weight of the drill collars 13 at the surface. Such weight causes the mandrel 28 to telescope up inside the housing 26, and the differential pressure on the piston 31 due to pressure drop across the bit jet ports 52 provides additional downward force on the bit. The orientation of the active cutters 53, 54 relative to the orientation of the directional package in the MWD tool 20 is known, so that as the magnetometers detect a certain range of azimuth angles during each rotation of the drill string 12, an electrical signal is sent to the solenoid actuator 46 to energize it and cause the valve element 44 to engage the seat 43, thereby shutting off the passage 42. When this occurs there is a temporary but substantial increase in the pressure $P_1$ relative to $P_2$, which produces a temporary increase in WOB.

The increase in WOB occurs synchronously with rotation of the drill suing 12 and thereby enables a directional borehole to be drilled. As an example, where the well bore is to be curved to the North as shown in FIG. 3, the operation of the control valve assembly 36 and the resulting temporary increase in WOB is made to occur as the active cutters 53, 54 on the bit 11 pass over the northerly side of the borehole bottom denoted by the angle Θ. This causes the bit 11 to drill preferentially against such North side face so that the borehole gradually is curved in the northerly direction. Of course the tungsten carbide inserts 55 will not cut as effectively as the active PDC cutters 53, 54, if at all.

A directional drilling system should be able to deviate a borehole at a rate of 3–5 degrees per 100 feet of borehole length. Experimentation has shown that the rate of deviation is a function of the ratio of the maximum WOB to minimum WOB. A ratio of two has been found to be optimum to achieve the desired deviation rates with acceptable bottom hole assembly designs.

Typical WOB's for an 8½" PDC bit fall in the range of from 10–20,000 lbs. Thus the WOB control mechanism 25 is capable of generating a dynamic change of 10,000 lbs. above a constant WOB of approximately 15,000 lbs., which varies the WOB from 15–25,000 lbs. with an average WOB of 20,000 lbs. Although systems capable of lower static and dynamic WOB's can be used, they may not be able to deviate the borehole at the desired minimum of 3–5 degrees per 100 feet. Thus a system having the foregoing capability is preferred.

The WOB control mechanism 25 also can be used primarily to control WOB. When the splines 27 are in a mid-position so that the housing 29 is not fully extended or collapsed relative to the housing 26, the WOB can be determined in accordance with the following formula:

$$WOB(lbs.)=A(P_B+P_0)-F_f \quad (1)$$

where

A = Area of piston 31 in square inches $P_B$ = Pressure drop across bit 11 in lbs. per square inch $P_0$ = Pressure drop across valve body 40 in lbs. per square inch $F_f$ = various frictional forces in lbs.

A specific feedback control system for generating a desired WOB would include the MWD tool 20 or other intelligent downhole electronics that is used to control the position of the valve element 44 based upon either a direct measurement of WOB, or a measurement of pressure above the valve body 40, which can be used to calculate WOB. A WOB controller of this type offers a number of advantages. For example, the downhole WOB can be accurately controlled. Surface control of WOB results in large variations because of the large number of perturbating influences between what is shown on the driller's weight gauge and the actual WOB. Factors such as borehole friction, hang-up on downhole steps, and dynamic interaction of the bit and the formation contribute to such variations. On the other hand, the controller disclosed herein is able to place a consistent, accurate WOB without being affected by the foregoing disturbances.

Moreover, the WOB can be controlled dynamically. Bit bounce, stabilizer hang-up and other dynamic effects can cause the WOB to vary dramatically over short periods of time. A downhole WOB controller as disclosed herein has a high bandwidth, allowing it to maintain the desired WOB except for extreme dynamic effects, thus improving the drilling efficiency.

In addition to dynamic control of WOB, the WOB control mechanism 25 is used in directional drilling in accordance with the present invention as described above. With active downhole WOB control, it becomes possible to increase the weight when the active cutters 53, 54 of the asymmetric bit 11 are passing through the desired azimuthal direction of deviation.

Figure 4:
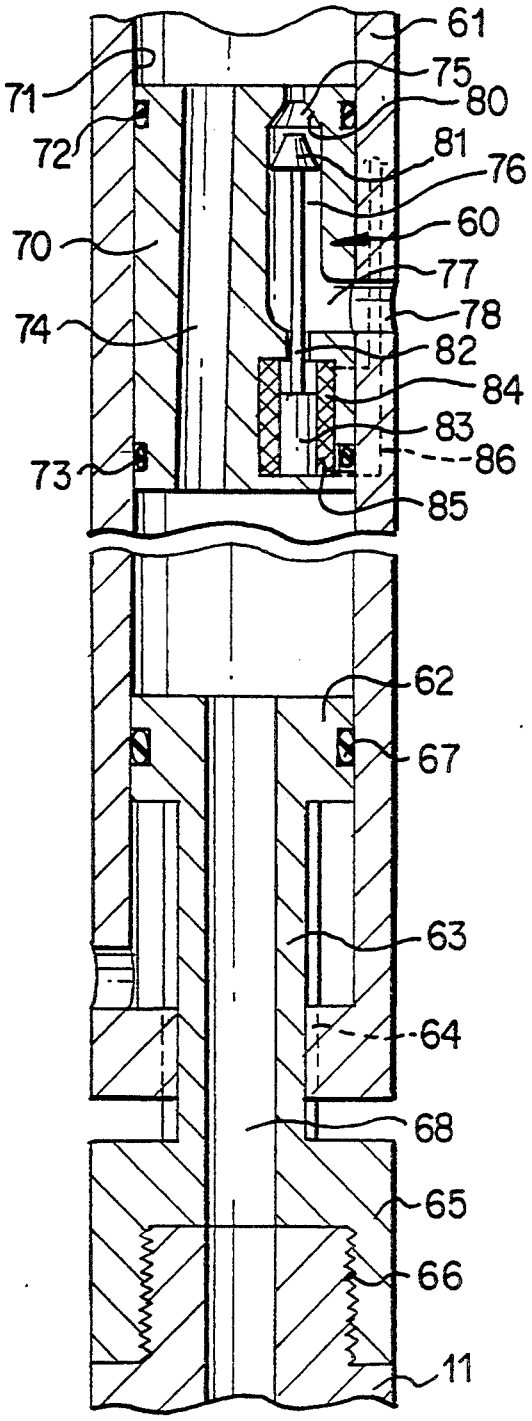
FIG. 4 is a longitudinal sectional view of another embodiment of the present invention.

Another embodiment of a steerable drilling system in accordance with the present invention is shown in FIG. 4. Here a control valve assembly 60 is mounted in a tubular housing member 61 which extends downward over a piston 62 on the upper end of a mandrel 63. The mandrel 63 and the lower end of the housing member 61 have mating splines 64 which allow limited longitudinal movement while preventing relative rotation. The lower end of the mandrel 63 is integral with a bit box 65 to which an asymmetrical bit 11 is attached by threads 66. A seal 67 prevents fluid leakage between the piston 62 and the inner wall of the housing member 61. The mandrel 63 has a central bore 68 through which drilling fluids pass to the bit 11.

The control valve assembly 60 includes a generally cylindrical valve body 70 that is fixed by suitable means (not shown) within the bore 71 of the housing member 61. Upper and lower seals 72, 73 prevent fluid leakage past the outside of the valve body 70. An open flow channel 74 extends longitudinally through the valve body 70, and a diverter passage 75 in the body includes a longitudinal upper portion 76 and a radial lower portion 77. The lower portion 77 is aligned with a port 78 which extends through the wall of the housing member 61 and communicates with the well annulus 16. A conical valve seat 80 is formed at the upper portion 76 of the diverter passage 75, and a conical valve head 81 on the upper end of a stem 82 is arranged to move upward against the seat 80 to close the passage 75, and downward to open the same. The stem 82 is connected to the core 83 of a solenoid 84 whose coil 85 and electric conductor leads 86 are connected through the synchronizing switch 56 (FIG. 1) to the power supply of the MWD tool 20.

In operation, the valve head 81 normally is closed against the seat 80 so that drilling fluids do not flow through the port 78. Thus the difference in pressure above and below the piston 62, due to pressure drop across the jet ports 52 of the bit 11, generates a pressure force that acts downwardly on the mandrel 63 and thus on the bit 11. This force, in addition to the collar weight that is applied to the bit 11, defines the total WOB. When the solenoid 84 is de-energized to allow the valve head 81 to move away from the seat 80 so that a portion of the drilling fluids can bypass to the well annulus 16, the pressure above the piston 62 is suddenly reduced. Thus there is a sudden reduction in total WOB to that which is due to the collar weight. When the valve head 81 closes by moving upward against the seat 80, downward force on the piston 62 and the bit 11 is suddenly increased to a higher value.

The switching of the solenoid 84 on and off is timed in the MWD tool 20 to occur synchronously during each rotation of the drill bit 11 so that WOB is increased when the PDC cutters 53, 54 are sweeping that side of the borehole bottom surface in which the azimuthal direction of the hole is to proceed, for example to the North as shown in FIG. 3. Thus the bottom portion of the borehole 10 will gradually curve and attain a higher inclination in that compass direction. As noted above, the synchronous switching can be accomplished in response to the output signals of the magnetometers in the MWD tool 20 which monitor the azimuth of the borehole indication.

It now will be recognized that new and improved directional drilling methods and systems have been disclosed. The tools provide temporary changes in WOB which are synchronized with rotation of the bit to occur when asymmetrical cutters are sweeping a selected side of the borehole bottom in which the azimuth of the borehole is to proceed. Since certain changes or modifications may be made in the disclosed embodiments without departing from the inventive concepts involved, it is the aim of the appended claims to cover all such changes and modifications falling within the true spirit and scope of the present invention.

What is claimed is:

1. Apparatus for use in drilling a directional borehole, comprising: tubular telescoping members connected in a rotary drill string, one of said members carrying a piston having upper and lower faces that are subject respectively to the pressures of drilling fluids inside and outside said members, said one member being attached to an asymmetrical drill bit; a synchronously operable means for changing the pressure acting on said upper face of said piston during a portion of each revolution of said members to cause the drill bit to drill a directional borehole.

2. The apparatus of claim 1 wherein said synchronously operable means includes a valve mounted in said one member and arranged to periodically restrict the flow of drilling fluids therethrough, each restriction of flow producing an increase in the pressure acting on said upper face of said piston.

3. The apparatus of claim 2 wherein said valve includes a plate having a flow passage therethrough and a valve seat surrounding said flow passage, and a valve element movable between a position against said seat to restrict said flow and a position away from said seat to allow flow therethrough.

4. The apparatus of claim 3 wherein said synchronously operable means further includes solenoid means operable when energized to cause said valve element to restrict said flow and operable when not energized to allow said valve to move away from said seat.

5. The apparatus of claim 1 wherein said synchronously operable means includes a valve mounted in the other of said members and arranged to periodically permit a bypass of a portion of the drilling fluids flowing therethrough to the well annulus externally thereof to cause a change in the pressure acting on said upper face of said piston.

6. The apparatus of claim 5 wherein said valve includes a body having a flow channel to enable continuous flow of a portion of the drilling fluids and a bypass channel leading to the well annulus, a valve seat surrounding a portion of said bypass channel, and a valve element movable between a position against said seat to close said bypass channel and a position away from said seat to allow a portion of the drilling fluid flow to bypass to the well annulus.

7. The apparatus of claim 6 further including solenoid actuator means for moving said valve to said position against said seat.

8. Apparatus for use in controlling the downward force applied to a rotary drill bit during the drilling of a borehole, comprising: tubular telescoping members having means for preventing relative rotation therebetween; means for connecting one of said members to a drill string and the other of said members to a drill bit; piston means on said other member subject to the difference in the pressure of drilling fluids inside and outside said members; and selectively operable valve means for changing the difference in pressure acting on said piston means to correspondingly change the downward force applied to the drill bit.

9. The apparatus of claim 8 wherein said valve means includes a flow passage through which drilling fluids pass during drilling, a valve seat surrounding said flow passage, and a valve element movable into engagement with said seat to block fluid flow through said passage and away from said seat to permit fluid flow therethrough.

10. The apparatus of claim 9 wherein said valve means further includes actuator means for moving said valve element in response to a control signal.

11. The apparatus of claim 10 further including means for measuring the downward force on the bit and for producing said control signal to maintain said force at a predetermined level.

12. The apparatus of claim 10 further including: means for measuring the pressure acting on said piston means and for producing said control signal to maintain said force at a predetermined level.

13. The apparatus of claim 8 further including a drill bit connected to said other member, said drill bit having asymmetrical cutters, said valve means being arranged to change said difference in pressure and thus the downward force on said drill bit each time said cutters rotate over that side of the borehole face which is in a certain azimuthal direction.

14. Apparatus for use in controlling the downward force applied to a rotary drill bit during the drilling of a borehole, comprising: a tubular housing having upper and lower ends; means at said upper end for connecting said housing to a drill string; a mandrel telescopically disposed in said lower end of said housing, said mandrel having a bore and upper and lower ends; means for connecting said lower end of said mandrel to a drill bit; spline means on said housing and mandrel for preventing relative rotation therebetween while permitting longitudinal relative movement; piston means on said upper end of said mandrel and being sealingly slidable in said housing, said piston means having upper and lower faces, said upper face being subject to the pressure of fluids in said housing above said piston means; means for subjecting said lower face of said piston means to the pressure as fluids in the borehole annulus; and selectively operable valve means in said bore of said mandrel for changing the pressure of fluids in said housing above said piston means to correspondingly change the downward pressure forces acting on said mandrel.

15. The apparatus of claim 14 wherein said valve means includes a valve seat in said bore of said mandrel, a valve element movable toward engagement with said seat to restrict fluid flow therethrough and away from said seat to increase fluid flow therethrough.

16. The apparatus of claim 15 wherein said valve means further includes actuator means for moving said valve element in response to a control signal.

17. The apparatus of claim 16 wherein said actuator means is a solenoid and said control signal is an electrical signal.

18. The apparatus of claim 17 further including means for measuring the downward force on the bit and for producing a level of said control signal that maintains said force at a selected value.

19. The apparatus of claim 17 further including means for measuring the pressure acting on said upper face of said piston means and for providing a level of said control signal that maintains said force at a selected level.

20. The apparatus of claim 14 further including a rotary drill bit connected to said lower end of said mandrel; asymmetrical cutter means on the lower face of said drill bit arranged to engage the bottom surface of the borehole during drilling; said valve means being arranged to change the downward pressure forces acting on said mandrel and drill bit during a portion of each revolution thereof, said portion lying generally in a certain azimuthal direction, whereby said drill bit tends to drill said borehole in said direction.

21. A method of drilling a directional borehole, comprising the steps of: providing a telescoping joint having a lower inner tubular member and an upper outer tubular member, said inner member being connected to a drill bit and having a pressure responsive piston thereon, said upper member being connected to the lower end of a drill string; corotatively coupling said members together in torque transmitting relation; providing said drill bit with asymmetrically arranged cutters on its lower surface; rotating said bit on the bottom surface of a borehole while supplying downward force thereto; and temporarily increasing said force during that portion of each revolution of said bit when said cutters pass over the general azimuthal direction in which the borehole is to curve by applying increased downward hydraulic force on said piston during said portion.

22. The method of claim 21 wherein said increased hydraulic force acting downwardly on said piston is generated by temporarily restricting the flow of drilling fluids past said piston.

23. The method of claim 21 wherein said increased hydraulic force acting downwardly on said piston is generated by reducing the pressure acting on said piston in response to bypassing a portion of the drilling fluids to the well annulus to reduce the force on the bit; and temporarily stopping said bypassing to momentarily increase said force.

* * * * *